US005318371A

United States Patent [19]

Niewulis

[11] Patent Number: 5,318,371

[45] Date of Patent: Jun. 7, 1994

[54] PINE TAR CARRIER AND DISPENSER

[76] Inventor: Steven A. Niewulis, 2105 5th Ave. NW., Hickory, N.C. 28601

[21] Appl. No.: 993,956

[22] Filed: Dec. 18, 1992

Related U.S. Application Data

[63] Continuation of Ser. No. 833,462, Feb. 7, 1992, abandoned.

[51] Int. Cl.[5] ..... A45C 11/00; B05C 21/00

[52] U.S. Cl. ..... 401/6; 224/219; 224/222; 401/7; 2/160; 2/170

[58] Field of Search ..... 401/7, 6; 273/32 B; 224/219, 220, 221, 222; 2/170, 160, 16

[56] References Cited

U.S. PATENT DOCUMENTS

| | | | |
|---|---|---|---|
| 1,281,605 | 10/1918 | Lloyd | 224/219 |
| 1,644,404 | 10/1927 | Squier | 224/219 X |
| 1,982,248 | 11/1934 | Gebhardt | 224/219 X |
| 2,438,037 | 3/1948 | Chapman, Jr. | 401/7 X |
| 3,826,407 | 7/1974 | Keating | 224/219 |
| 4,068,318 | 1/1978 | McMahon | 2/170 |
| 4,341,331 | 7/1982 | McDougall | 224/222 X |
| 4,763,821 | 8/1988 | Powell | 224/222 X |
| 4,805,242 | 2/1989 | Bolton | 2/160 |
| 4,884,297 | 12/1989 | Triche | 2/16 |
| 4,909,650 | 3/1990 | Gilbert | 401/196 |
| 4,913,326 | 4/1990 | Echelson | 224/222 |
| 5,020,711 | 6/1991 | Kelley | 224/222 |
| 5,060,943 | 10/1991 | Stoffo | 273/32 B |

*Primary Examiner*—Steven A. Bratlie

*Attorney, Agent, or Firm*—Malin, Haley, DiMaggio & Crosby

[57] ABSTRACT

A pine tar carrier and dispenser for use by baseball and softball players that can be conveniently mounted on their wrist and forearm and that includes a pine tar applicator that can be safely covered up when not in use, but readily accessible while even at home plate for applying pine tar or pine tar substitute to a bat.

18 Claims, 3 Drawing Sheets

PINE TAR CARRIER AND DISPENSER

This is a continuation of copending application Ser. No. 07/833,462 filed on Feb. 7, 1992, now abandoned.

BACKGROUND OF THE INVENTION

1. Field of the Invention

This invention relates generally to a pine tar (or sticky substance) dispenser for use with the game of baseball and specifically to a pine tar carrier and dispenser that can be carried at all times by the ballplayer for easy access during batting without disruption.

2. Description of the Prior Art

Pine tar is used in the game of baseball to provide a sticky coating on a baseball bat for better grip by a baseball hitter. Pine tar is a sticky dark pine tree derivative that is typically rubbed on a batter's gloves or bat to create a better grip. In the past, pine tar has been applied by rubbing the bat with a cloth or towel that is saturated with the sticky substance. A pine tar bat is a bat that has been rubbed with a pine tar rag to give the batter a better grip. Devices for applying pine tar are known. U.S. Pat. No. 5,060,943, issued to Stoffo on Oct. 29, 1991, shows an aid for improving the gripping of a hand held sporting implement that uses various cloths for dispensing pine tar.

U.S. Pat. No. 4,909,650 shows a pine tar applicator that is positioned in a form roller for support by the backstop or adjacent the hitting area. The major drawback with these devices is that for a batter to apply the pine tar to his gloves or to the bat, he must walk from home plate to the pine tar rag, during the batting cycle, and cause disruption of the game for the pine tar application. The present invention eliminates this inconvenience and slowdown of the game by having a pine tar applicator that is carried on the batter at all times in the form of a wrist band or other limb band. The invention further includes a convenient closure so that when not in use, the pine tar, or sticky substance, is hidden and cannot be misapplied or transferred to other surrounding objects The primary use is while a batter is at home plate or in a batting cage. For example, a batter can forget the pitching count (which could be embarrassing) by being distracted away from the home plate area while at bat in order to apply pine tar. The present invention also includes removable pine tar absorbent cloth panels that can allow the wrist band area and other portions of the device to be conveniently washed or cleaned when necessary.

BRIEF SUMMARY OF THE INVENTION

A pine tar carrier and dispenser for use primarily by a baseball player, whether professional or amateur, comprising a flexible band for mounting on the limb of the player, at least one fabric fastener panel connected to an outside portion of the band, and an absorbent cloth suitable for containing pine tar connected to said fabric fastener by the opposing fabric fastener (hook and loop) so that said absorbent cloth can be removed from the limb band and a means for covering the pine tar absorbent cloth when the device is not in use, but carried on the person.

In one embodiment, the limb encircling band can be a sweat band (knitted fabric) sized to fit around the wrist and a portion of the forearm, shaped like a tube or cylinder, that can slide over the hand (or foot) The diameter of the knitted fabric wrist band tube is such to fit a variety of people so that different size wrist bands or forearm bands are envisioned. Although described as a knitted fabric, the wrist band could be made of other, preferably fabric-type, materials (cotton, canvas, or even leather) A portion of the outside surface of the knitted wrist band has permanently sewn a fabric fastener (loop or hook) known under the trademark "VELCRO" section A pine tar absorbent cloth panel, made of an absorbent material such as cotton, has an opposing fabric fastener attached permanently to one side, the opposite fabric fastener (hook or loop) to that already attached to the outside wrist band. For example, if the outside wrist band has VELCRO loops, then one side of the pine tar cloth has VELCRO hooks. Thus, the pine tar absorbent cloth containing the pine tar can be removed from the wrist band because of the fabric fasteners. In addition, a second panel which is attached movably as a flap to the wrist band contains also a fabric fastener on one side which is the opposite of the fabric fastener permanently attached to the wrist band. A smaller cotton absorbent cloth for containing pine tar also includes yet another fabric fastener on one side which allows it to be attached to the secondary flap. The flap covers the pine tar cloths in the closed position, while permitting access to the pine tar in the open position The end result is that the device has a movable flap with a portion having a removable cotton absorbent surface that contains pine tar that can be movably disposed face to face with another cotton panel containing pine tar cloth that are mounted by fabric fasteners to the wrist band, with the borders of the fabric fastener flap panel and the borders of the fabric fastener on the wrist band being large enough so that the borders can engage, allowing the entire unit to be closed tightly so that no facet of the panels containing the pine tar are exposed when the unit is closed.

Therefore, to operate the device, a person coming up to bat or while at bat merely needs to open the flap exposing two absorbent cloth panels, each containing pine tar, and tap the device with the baseball bat, allowing pine tar to be transferred from the absorbent cloth to the bat, as desired. Upon completion of that transfer, the batter merely takes the flap and closes it securely in place, whereby the absorbent cloths are not exposed and are firmly hidden inside the flap.

Although there are other possible modifications such that the flap need not be attached along a seam, it is believed that by using the flap access, two absorbent cloth panels containing pine tar are exposed simultaneously, allowing for greater area for the bat to be placed against. The invention can be used to displace other sticky substances that are pine tar substitutes or rosin It is an object of this invention to provide an improved pine tar carrier and dispenser that can be carried by the ballplayer to add convenience to the game, while allowing the pine tar to be carried in a protected environment when not in use.

It is another object of this invention that allows a baseball player to apply pine tar to his bat, even when he is standing in the batter's box, both quickly and conveniently without danger of getting excess pine tar on any other objects.

Yet still another object of this invention is to provide an improved pine tar carrier and dispenser that can be carried literally on the limb of the user for application of pine tar on a bat or batting gloves for improved gripping and dispensing when desired in a convenient and timely fashion.

In accordance with these and other objects which will become apparent hereinafter, the instant invention will now be described with particular reference to the accompanying drawings.

PREFERRED EMBODIMENT OF THE INVENTION

Figure 1:
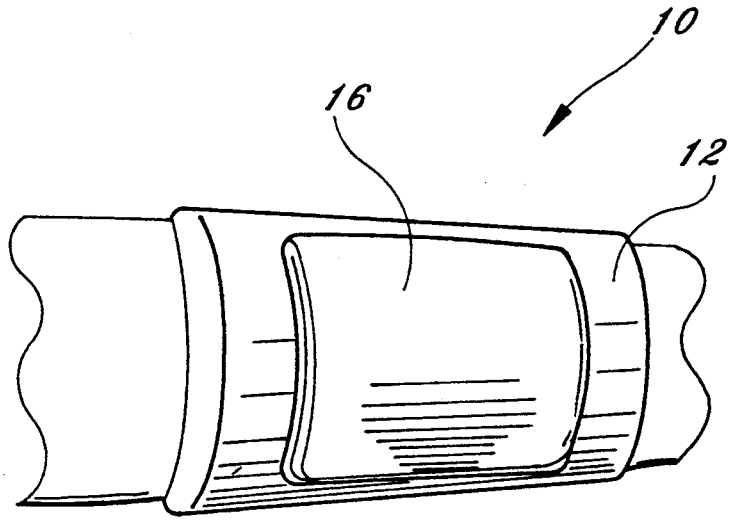
FIG. 1 shows a top plan view of the present invention disposed on a cutaway portion of a ballplayer's wrist and forearm.

Referring now to the drawings, and specifically FIG. 1, the present invention is shown generally at 10 mounted on the limb, wrist, and forearm of the user, which would typically be a baseball player. This device can be used throughout baseball, whether professional or minor leagues, or by anyone who needs access to pine tar or other sticky substance. Specifically, the invention 10 is comprised of a knitted wrist sweatband 12 that is tubularly shaped and sized in length to reach approximately from the wrist to the forearm area of a typical user and has a diameter so that it can comfortably fit about the wrist and forearm. Multiple sizes can be manufactured for different age groups and size players. The wrist band 12, which may be made of a knitted cotton or synthetic fabric, has a flap covered by a vinyl, canvas, leather or plastic cover 16 to which advertising indicia can be placed. Underneath the vinyl indicia-bearing advertisement 16 is a flap 22, as shown in FIG. 2, having a fabric fastener lining.

Figure 4:
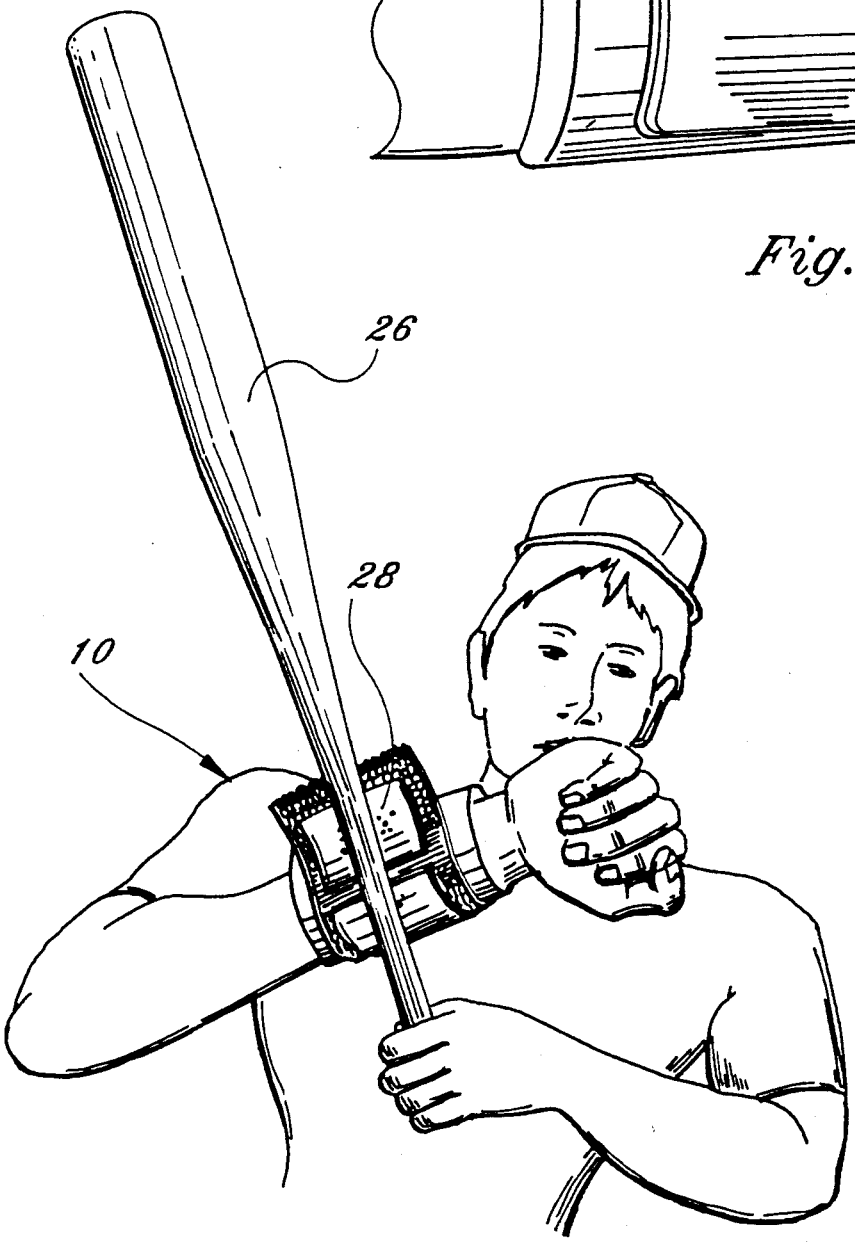
FIG. 4 shows a graphic illustration of a ballplayer using the present invention.
Figure 2:
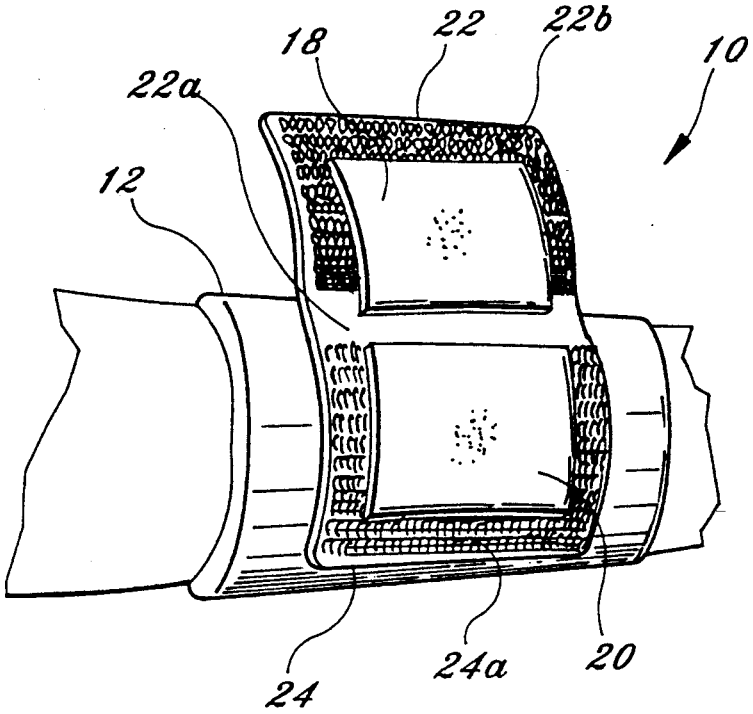
FIG. 2 shows a top plan view of the view shown in FIG. 1 with the flap open.
Figure 3:
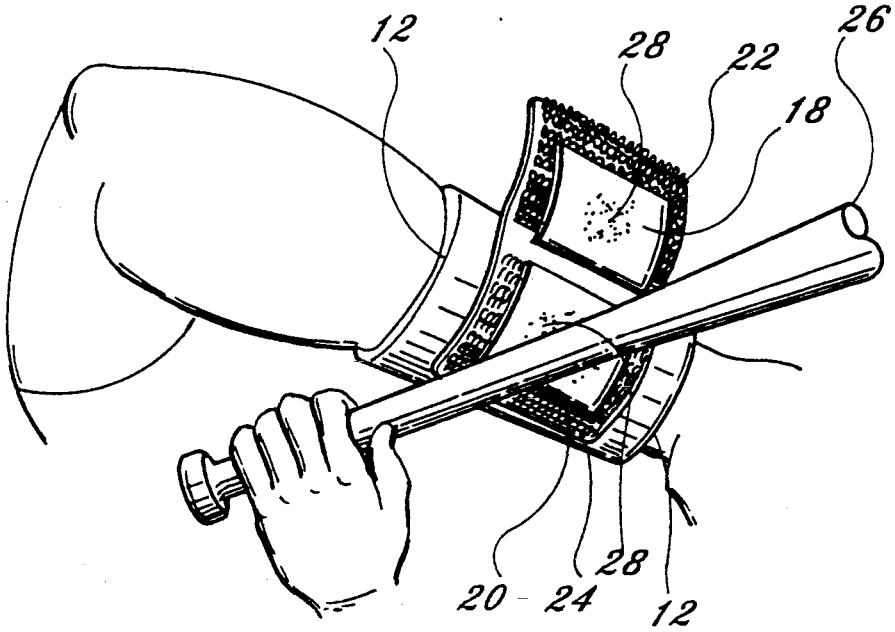
FIG. 3 shows a front view of the ballplayer's bat and forearm portion with the device in operation.

Referring to FIG. 2, the invention 10 is shown with flap 22 open, the flap 22 being movably connected along a seam **22*a* to a second fabric fastener panel 24 that is attached (by sewing) permanently to band 12. Panel 24 does not move, but can engage panel 22 in a closed position when the panel 22 is placed firmly against panel 24 because of the opposing VELCRO fasteners (hook and loop). The border area 22*b* matches up with the border area of 24*a* and since the borders are fabric fastener panels having opposite connectors, such as loops and hooks, the borders lock together, closing the flap firmly. Therefore, the inside surface of flap 22 would have loop fabric fasteners (known as VELCRO), while panel 24 would have hook fasteners with the exposed borders 22*b* and 24*a* permitting the entire flap to be closed. However, attached to fabric fastener panel 22 is a smaller in area pine tar absorbent cloth 18, rectangular, but smaller to permit exposure of the fabric fastener along border 22*b*. The back side (not shown in FIGS. 2, 3, and 4) of absorbent cloth 18 has another fabric fastener attached to allow the absorbent cloth to be attached to panel 22. Thus, the absorbent cloth 18 which is used to receive the pine tar can be removed from flap 22** because of the Velcro fabric fasteners on its back side to permit washing of the device or replacement of the absorbent panels.

Figure 5:
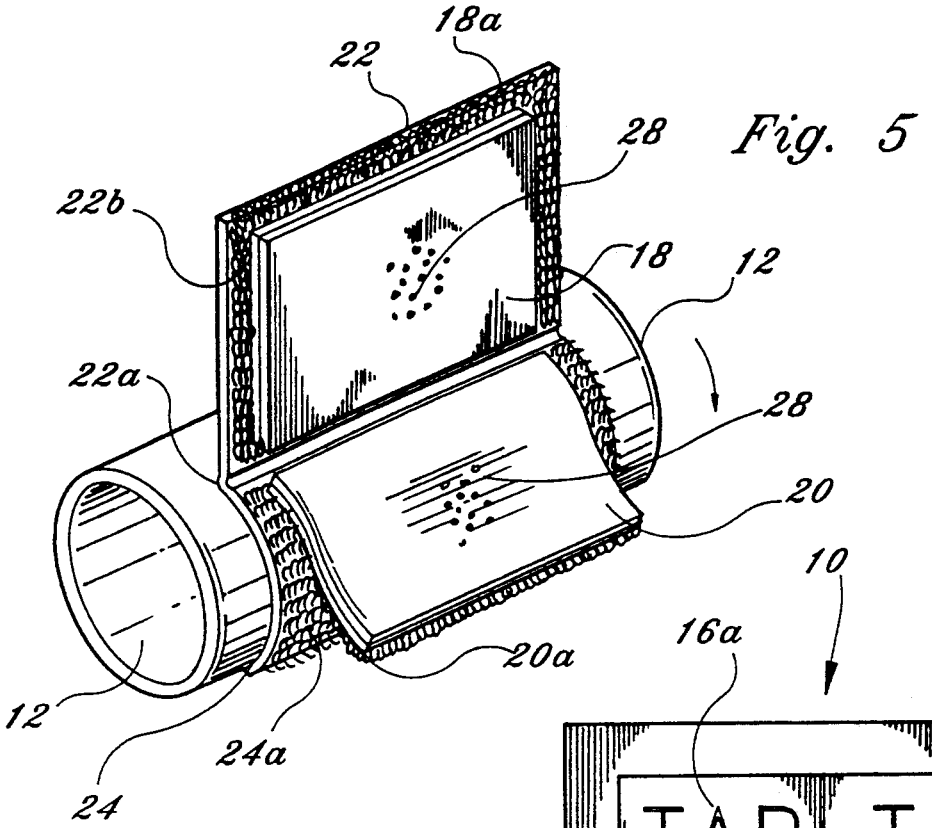
FIG. 5 shows a perspective view of the pine tar carrier and dispenser with the flap in an open position with portions of the cotton absorbent pads being flipped back near the corners for the purpose of illustration of the invention.
Figure 7:
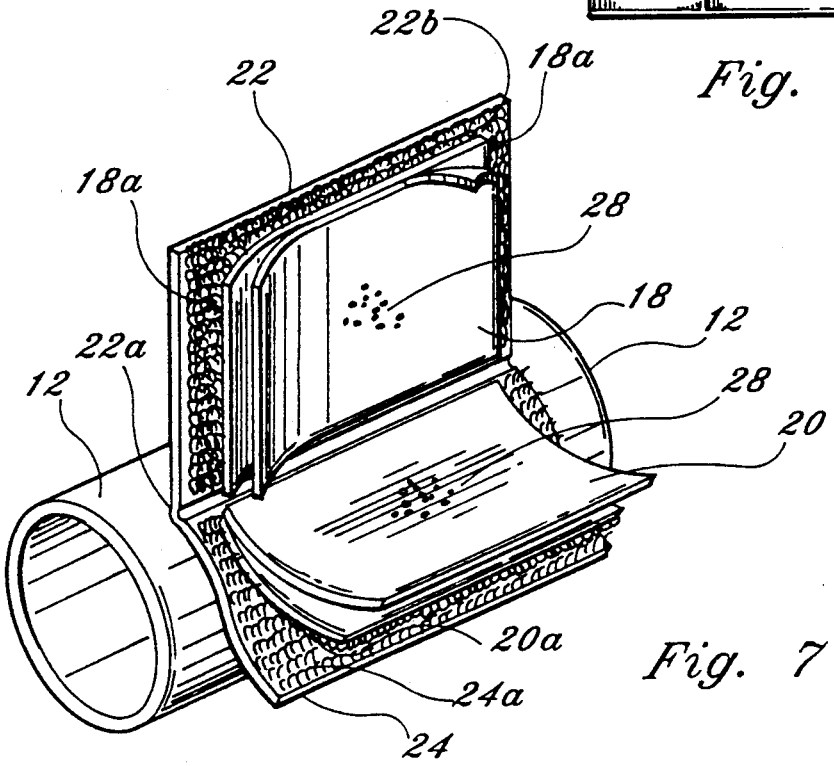
FIG. 7 shows a perspective view of the pine tar carrier and dispenser with the flap in the open position and showing the absorbent pads being removably attached.

Another absorbent cloth 20 is likewise attached by a fabric fastener on one side to fabric fastener panel 24 and can be removed. The absorbent cloth 20 also has pine tar disposed on it (indicated at element 28 in FIGS. 3 and 4) so that when the flap 22 is open, exposing both absorbent cloths 18 and 20, bat 26 can be tapped against both cloth panels, allowing pine tar to be applied to the bat 26. Because of its sticky nature, the pine tar will transfer from the cloth, which may be cotton or the like, to the baseball bat Referring now to FIGS. 5 and 7, the wrist band 12 is shown with a fabric fastener panel 24 comprised of hooks sewn to the wrist band 12 permanently. Absorbent cloth 20 includes on its back side a fabric fastener loop panel **20*a* which allows the absorbent cloth 20 to be removably attachable to fabric fastener panel 24. A separate flap 22 includes a fabric fastener which also has loops allowing the border area 22*b* to be attached to panel 24 along border area 24*a* closing the device. Likewise, panel 18 has a fabric fastener backing 18*a* which has hooks which allows absorbent cloth 18 to be removed from flap 22. In the closed position, however, as shown in FIG. 1**, none of the pine tar or the absorbent cloth panels are shown at all.

Figure 6:
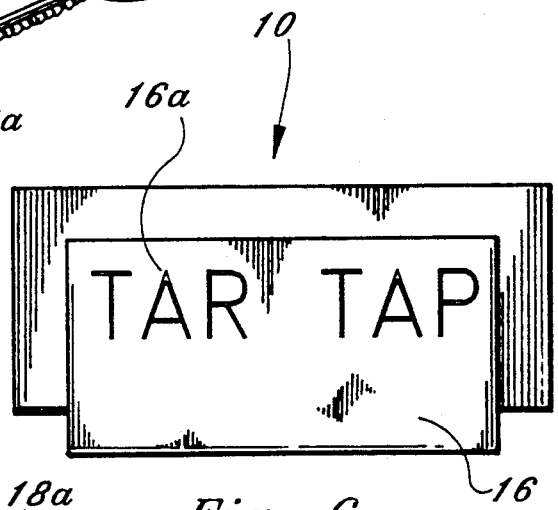
FIG. 6 shows the present invention in a closed position with indicia written on the top flap cover.

FIG. 6 shows the invention in a closed position with an upper cover 16 made of a synthetic vinyl or the like that includes indicia **16*a*** written on it that could be carried by ballplayers as an advertisement for various types of products, the indicia being shown here as the words "tar tap".

The absorbent cloths 18 and 20 may be removed from the device so that the entire wrist band and fabric fastener can be washed, dried, and cleaned as desired without the pine tar material being involved in the washing and drying process. The absorbent cloth panels can be changed and quickly installed as desired.

The device may also be designed for attachment to a belt or other article of apparel in an alternative embodiment The invention can be utilized in other sports and leisure activities that could also include other sticky or drying agents (rosin).

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable pine tar carrier and dispenser that can be carried or worn by a person comprising:

means for containing pine tar;

means for attaching said means for containing to a human body; and means for completely covering said means for containing to avoid exposing the pine tar when the pine tar is not needed, said means for completely covering including a fabric fastener panel connected to said means for attaching, said fabric fastener panel having an inner surface and an outer surface, said fabric fastener panel having hook material disposed on its inner surface, said fabric fastener panel having a flap panel attached along a seam thereto, said flap panel having an inner surface and an outer surface, said flap panel having loop material disposed on its inner surface, such that when said flap panel is folded along the seam, the flap panel loop material engages the fastener panel hook material.

2. A device as in claim 1, wherein said means for attaching includes a means for attaching to a human limb.

3. A pine tar dispenser as in claim 2 wherein said means for attaching to the human body includes a 2 wrist band.

4. A pine tar dispenser as in claim 3, wherein said wrist band includes an absorbent means that is flexible and tubular in shape and sized to fit around the wrist and forearm portion of the body.

5. A pine tar dispenser as in claim 2, wherein said means for containing includes at least one absorbent cloth panel.

6. A pine tar dispenser as in claim 5, wherein said absorbent cloth panel has pine tar disposed thereon, wherein said absorbent cloth panel is removably attached to said means for attaching said means for containing.

7. A pine tar dispenser as in claim 6, wherein said means for containing includes a second absorbent cloth panel removably attachable to said means for completely covering said means for containing, wherein said second absorbent cloth panel has pine tar disposed thereon.

8. A pine tar dispenser as in claim 7, wherein said first and second absorbent cloth panels include fabric fastening means attachable to means for attaching to a human limb and said means for covering, respectively.

9. A portable pine tar carrier and dispenser that can be carried or worn by a person comprising:

means for containing pine tar;

means for attaching said means for containing to a human limb, said means for attaching including a limb encircling band means, said band means including an absorbent means that is flexible and tubular in shape and sized to fit around a human limb; and means for completely covering said means for containing to avoid exposing the pine tar when the pine tar is not needed;

said means for containing including a first absorbent cloth panel, said first absorbent cloth panel being removably attached to said means for attaching said means for containing, said first absorbent cloth panel having pine tar disposed thereon;

said means for containing further including a second absorbent cloth panel, said second absorbent cloth panel being removably attached to said means for completely covering said means for containing, said second absorbent cloth panel having pine tar disposed thereon.

10. A portable pine tar carrier and dispenser as in claim 9, wherein said first and second absorbent cloth panels include fabric fastening means attachable to said band means and said means for completely covering said means for containing, respectively.

11. A portable pine tar carrier and dispenser as in claim 9, wherein said means for attaching is a wrist band means sized to fit around the wrist and forearm portion of a human body.

12. A portable pine tar carrier and dispenser that can be carried or worn by a person comprising:

means for containing pine tar;

means for attaching said means for containing to a human limb, said means for attaching including a limb encircling band means, said band means including an absorbent means that is flexible and tubular in shape and sized to fit around a human limb;

said means for containing including a first absorbent cloth panel and a second absorbent cloth panel, each of said first and second absorbent cloth panels having a front side and a back side, each of said first and second absorbent cloth panels having an amount of pine tar disposed thereon;

a fabric fastener panel attached to said band means, said fabric fastener panel having an inner surface and an outer surface, said fabric fastener panel having hook material disposed on its inner surface;

said first absorbent cloth panel connected to said fabric fastener panel, said first absorbent cloth panel having loop material disposed on its back side, wherein said first absorbent cloth panel is removably attached to said fabric fastener panel;

a flap panel attached along a seam to said fabric fastener panel, said flap panel having an inner surface and an outer surface, said flap panel having loop material disposed on its inner surface;

said second absorbent cloth panel connected to said flap panel, said second absorbent cloth panel having a front side and a back side, said second absorbent cloth panel having hook material disposed on its back side, wherein said second absorbent cloth panel is removably attached to said flap panel; and an upper cover attached to the outer surface of said flap panel, such that when said flap panel is folded along the seam, the flap panel loop material and the fastener panel hook material engage, thereby completely covering said means for containing to avoid exposing the pine tar when the pine tar is not needed.

13. A portable pine tar carrier and dispenser that is worn by a person comprising:

means for containing a non-slip substance;

means for attaching said means for containing to a human body, said means for attaching including a wrist band, said wrist band including an absorbent means that is flexible and tubular in shape and size to fit around the wrist and forearm portions of the body; and means for covering said means for containing to avoid exposing said substance when said substance is not needed, said means for covering including a fastener panel connected to an outside portion of said wrist band, a flap panel, and hook-and-loop fasteners disposed on opposite faces of said fastener panel and said flap panel to hold said fastener panel and said flap panel together.

14. A pine tar dispenser as in claim 13 wherein said non-slip substance is pine tar.

15. A pine tar dispenser as in claim 13, wherein said non-slip substance is rosin.

16. A pine tar dispenser as in claim 13, wherein said means for containing includes at least one absorbent cloth panel impregnated with said non-slip substance, said absorbent cloth panel being removably attached to said fastener panel.

17. A pine tar dispenser as in claim 16, wherein said means for containing further includes a second absorbent cloth panel impregnated with said non-slip substance, said second absorbent cloth panel being removably attached to said flap panel.

18. A pine tar dispenser as in claim 13 wherein said means for containing includes at least one absorbent cloth panel impregnated with said non-slip substance, said absorbent cloth panel being removably attached to said flap panel.

* * * * *